United States Patent [19]

King, Sr.

[11] 3,980,332

[45] Sept. 14, 1976

[54] SEALS FOR METERS AND THE LIKE

[75] Inventor: Karl G. King, Sr., DeLand, Fla.

[73] Assignee: Inner-Tite (Division of Yara Engineering Corporation), Springfield, N.J.

[22] Filed: Sept. 9, 1975

[21] Appl. No.: 611,655

[52] U.S. Cl. ..... 292/320

[51] Int. Cl.[2] ..... B65D 33/34

[58] Field of Search ..... 292/317, 318, 320, 321, 292/322, 323

[56] References Cited

UNITED STATES PATENTS

| | | | |
|---|---|---|---|
| 1,014,252 | 1/1912 | Palmer | 292/320 |
| 1,054,440 | 2/1913 | Murray | 292/320 |
| 1,908,241 | 5/1933 | Heeren et al. | 292/327 |
| 3,485,521 | 12/1969 | Moberg | 292/320 |
| 3,591,223 | 7/1971 | Neto | 292/320 |

*Primary Examiner*—Richard E. Moore
*Attorney, Agent, or Firm*—Buell, Blenko & Ziesenheim

[57] ABSTRACT

A seal for meters and the like is provided having a generally rectangular housing with a central slot passing therethrough, a generally U-shaped shackle member having at each end a reversely bent inwardly extending hook insertable in said slot and keeper means inserted into said slot from the end opposite the shackle member, said keeper means having opposed notches intermediate its ends engaging the hook means of the shackle within the housing and breakable stop means on the keeper means limiting movement of the keeper into the slot to hold the notches and hook means in the housing and when the stop means are broken to permit the keeper to pass fully through the slot.

9 Claims, 7 Drawing Figures

SEALS FOR METERS AND THE LIKE

This invention relates to seals for meters and the like and particularly to a readily applied and removed inexpensive seal of plastic adapted for use on meters and the like.

Seals for meters, box cars, shipping containers and the like have long been used. These have taken various forms such as for example a wire loop through a deformable lead slug, a wire shackle having hook means embedded into a plastic housing as disclosed in U.S. Pat. No. 3,485,521 and various other types of similar devices as disclosed in U.S. Pat. Nos. 402,125; 503,110; 513,980; 523,382; 654,598; 673,996; 884,604; 998,878; 1,011,231; 1,626,273; 1,878,991; 1,943,988; 1,964,013; 1,964,897; 2,006,042; 2,020,198; 2,610,879; 3,128,114; 3,186,047; and 3,375,033.

Such seals as have been heretofore provided have been relatively costly both to make and to install and in many cases their removal requires effectively destroying them so that no part can thereafter be used. In some cases it is possible to remove the shackle portion and thereafter reshape and reapply it, which destroys their effectiveness because it does not warn that the seal has been broken.

The present invention provides a seal which prevents removal of the shackle without destruction of a part of the seal making it incapable of use without replacement of that part but making it possible to reuse the major portions of the seal, substituting only the broken part.

The seal of this invention provides a housing of generally more deformable plastic material having a central slot passing therethrough, a U-shaped shackle having at each end a resilient reversely, bent wire hook with a divergent free end portion insertable into said slot, and keeper means insertable in said slot from the end opposite the shackle, said keeper means having opposed notches on one end within the slot engaging the divergent ends of the wire hooks of the shackle and stop means on the other end limiting movement of the keeper into the slot. Preferably stop means are provided within the slot limiting movement of the hook means within the slot so that both the hook means and keeper means are held against movement within the slot when in engagement. The seal is removed by breaking the stop means from the keeper and pushing the entire keeper through the slot along with the shackle.

In the foregoing general description of my invention I have set out certain objects, purposes and advantages to be achieved thereby. Other objects, purposes and advantages will be apparent from a consideration of the following description and the accompanying drawings in which.

Figure 1:
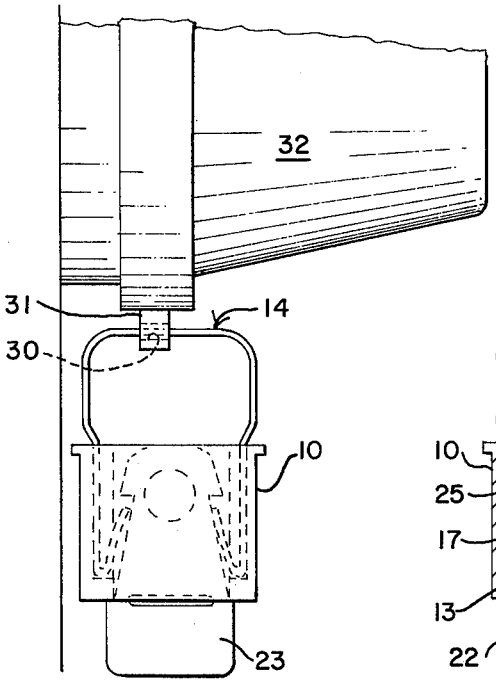
FIG. 1 is an elevational view of the seal of this invention applied to a meter and in locked condition.
Figure 2:
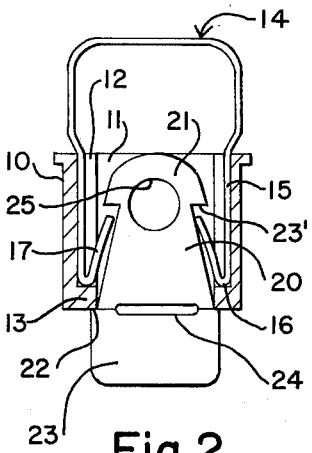
FIG. 2 is a section through the seal of FIG. 1.
Figure 3:
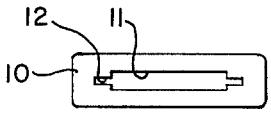
FIG. 3 is a top plan view of the housing for the seal of FIG. 1.
Figure 4:
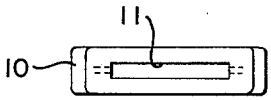
FIG. 4 is a bottom plan view of the housing for the seal of FIG. 1.
Figure 5:
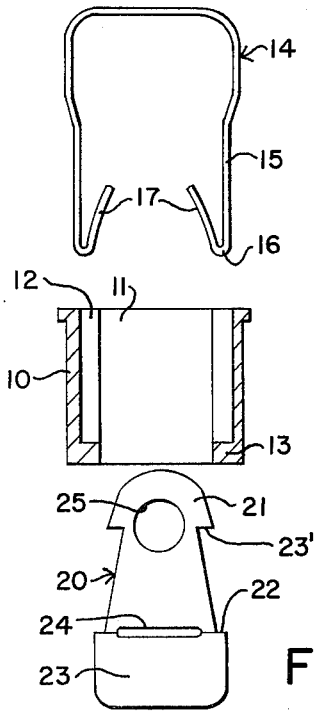
FIG. 5 is an exploded side elevational view of the separate parts of the seal of FIG. 1.

Referring to the drawings I have illustrated a housing 10 having an elongated slot 11 extending from top to bottom. Each side of slot 11 is provided with auxiliary slots 12 extending from the top 10*a* of the housing to a point intermediate the top and bottom and terminating in stops 13. A wire shackle 14, of stiff spring wire, is provided having a generally U-shaped with legs 15 connected by loop portion 16 and with their free ends inwardly and slightly upwardly bent to form reversely bent hook portions 17. A keeper 20 of semi-resilient plastic having a top portion 21 of the same general cross-sectional size and shape as slot 11 is adapted to slide into slot 11 until it reaches stop 22 on each side of the bottom portion 23. The top portion of keeper 20 is provided with notches 23 on each side intermediate the top end 21*b* and stops 22 adapted to receive the hook portions 17 of the shackle. The top end 21 is tepered or curved to guide the free ends of the shackle as the parts are assembled. The bottom 23 of keeper 20 is partially separated from the top 21 portion by perforation 24. An opening 25 is preferably provided in end 21 for added resilience in assembly.

In operation the wire shackle 14 is inserted through opening 30 in hasp assembly 31 of meter 32 the ends of the shackle legs are inserted in auxiliary slots 12 of housing 10 until the hook portions 17 bottom on stops 13. The keeper 20 is inserted into slot 11 from the bottom until the notches 23 engage hook portions 7. In this condition the shackle is locked in place and cannot be removed except by breaking off bottom 23 with stops 22 and pushing keeper 20 through the top of housing 10 along with the shackle.

The only part destroyed by removing the seal is keeper 20. The housing 10 and shackle 14 can be reused, adding only a new keeper with stops 22.

Figure 6:
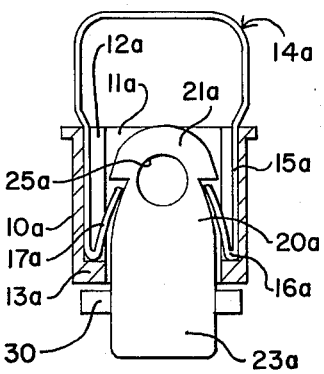
FIG. 6 is a vertical section through a second embodiment of seal according to this invention.

In FIG. 6 I have illustrated a second embodiment of this invention in which parts which correspond to those of FIGS. 1–5 are given identical numbers with the suffix *a*. The only difference between this embodiment and that of FIGS. 1–5 is in the substitution of break off stops 30 on the sides of the keeper instead of stops 22 around the whole of bottom portion 23. Thus only stop tabs 30 are broken off in this embodiment rather than the entire bottom portion as in FIGS. 1–5.

Figure 7:
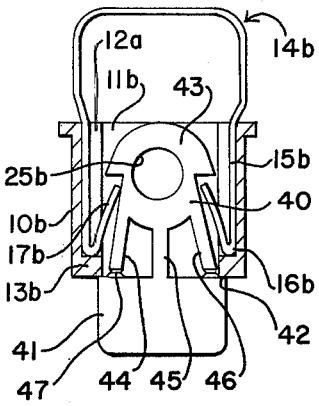
FIG. 7 is a vertical section through a third embodiment of seal according to this invention.

In FIG. 7 I have illustrated a third embodiment of my invention. Again, those parts which find identity in corresponding parts of FIGS. 1–5 bear like numbers with the suffix *b*. In this embodiment the keeper 40 has a bottom portion 41 with surrounding shoulder stops 42 separated from the top 43 by three legs 44, 45 and 46, the outer two 44 and 46 of which are weakened at their juncture with bottom 41 by grooves 47. In this embodiment bottom 41 is turned around the axis of leg 45 to break legs 44 and 46 at grooves 47 and then continued to turn so that the center leg 45 is bent in a spiral until it breaks. This prevents any possible attempt to replace the bottom by cementing or gluing.

The housing 10 is preferably made of clear transparent plastic so as to provide visible evidence in the event that the seal has been tampered with. The keeper, on the other hand, is preferably made of a bright colored, rather brittle plastic. The shackle is preferably made from half hard stainless steel wire such as Type 201 or 301 stainless.

It is, of course, obvious that while I have illustrated and described, certain preferred embodiments of this invention, the invention may be otherwise embodied within the scope of the following claims.

I claim:

1. A seal for meters and the like comprising a generally rectangular housing having a central slot passing therethrough, a generally U-shaped fastening shackle member having at each end a reversely bent inwardly extending hook insertable into one end of said slot and keeper means inserted into said slot from the end opposite the shackle member, said keeper means having opposed notches intermediate its ends engaging the hook means of the shackle within the housing, stop means on the keeper means engaging the housing and limiting movement of the keeper into the slot to hold the notches and hook means in the housing and a frangible connection defining the stop means from the keeper means, said slot being dimensioned to permit passage of the shackle member and keeper free of the stop means through said one end whereby when the stop means are broken it permits the keeper and shackle to pass fully through the slot and said one end.

2. A seal for meters and the like as claimed in claim 1 wherein the housing is of substantially nondeformable transparent plastic.

3. A seal for meters and the like as claimed in claim 1 wherein the shackle is of spring steel wire.

4. A seal for meters and the like as claimed in claim 1 wherein stop means are provided in the slot limiting movement of the shackle into the slot.

5. A seal for meters and the like as claimed in claim 4 wherein the stop means includes auxiliary slot portions along the edge of the slot terminating in a shoulder intermediate the length of the slot.

6. A seal for meters and the like as claimed in claim 1 wherein the keeper means is provided with a tapered end portion adjacent the notches to guide and urge the shackle ends into the notches.

7. A seal for meters and the like as claimed in claim 1 wherein the keeper bottom is enlarged to provide shoulders bearing on the housing and said enlarged bottom is defined by at least one perforation separating it from the body of the keeper whereby the bottom may be broken away from the keeper body.

8. A seal for meters and the like as claimed in claim 1 wherein perforations form a plurality of legs between the bottom and body of the keeper, at least one of which is spirally twisted in removing the bottom.

9. A seal for meters and the like as claimed in claim 1 wherein the breakable stop means on the keeper are a pair of tabs extending from opposite edges of the keeper bottom portion.

* * * * *

UNITED STATES PATENT OFFICE

CERTIFICATE OF CORRECTION

PATENT NO. : 3,980,332

DATED : September 14, 1976

INVENTOR(S) : Karl G. King, Sr.

It is certified that error appears in the above-identified patent and that said Letters Patent are hereby corrected as shown below:

Column 2, line 19, "tepered" should read --tapered--.

Column 2, line 30, "7" should read --17--.

Signed and Sealed this

Sixteenth Day of November 1976

[SEAL]

*Attest:*

RUTH C. MASON
*Attesting Officer*

C. MARSHALL DANN
*Commissioner of Patents and Trademarks*